US006174241B1

(12) United States Patent
Setteducati et al.

(10) Patent No.: US 6,174,241 B1
(45) Date of Patent: Jan. 16, 2001

(54) BOOK-FORM MAGIC SET

(76) Inventors: Mark Setteducati, 218 E. 17 St.; Anne Benkovitz, 93 1st Ave., Apt. 3C, both of New York City, NY (US) 10003

( * ) Notice: Under 35 U.S.C. 154(b), the term of this patent shall be extended for 0 days.

(21) Appl. No.: 09/303,371

(22) Filed: Apr. 30, 1999

(51) Int. Cl.[7] ..... A63J 21/00
(52) U.S. Cl. ..... 472/72; 472/71
(58) Field of Search ..... 472/72, 71, 75, 472/81, 57; 40/390, 400; 434/429, 430

(56) References Cited

U.S. PATENT DOCUMENTS 5,445,565 8/1995 Setteducati ..... 472/57

OTHER PUBLICATIONS

"The Nine Mystery" Article in "The Magic Book" Published by Karl Fulves in 1977. U.S.A.
"The Magic Show" Authored by Richard Fowler & David Wood Published 1995 by Hazar Publishing, London G.B.
"The Best Pop–Up Magnic Book Ever" Published by Orchard Books London G.B. 1998 Authored by Matt Johnston & Richard Fergusson.

*Primary Examiner*—Kien T. Nguyen
(74) *Attorney, Agent, or Firm*—Robert W. J. Usher

(57) ABSTRACT

A magic set comprises of a plurality of leaves form a book. The book is provided with at least one portion for holding movable props at predetermined different display locations on faces thereof and a prop moved by a user in accordance with the directions between different display locations on one face of a leaf in the performance routine of one trick mechanically interacts with one of trick indicia and a prop on an opposite face of the one leaf to determine an outcome of one of a same and another, previously initiated trick, while a portion of the prop which would reveal a solution to the one of a same and another trick remains undetected throughout the performance of routines of both tricks performance.

22 Claims, 17 Drawing Sheets

BOOK-FORM MAGIC SET

FIELD OF THE INVENTION

The invention relates to a magic set formed as a book of magic with pages carrying props and directions for performing tricks by which users who are uninformed of the trick secrets and underlying mechanisms are themselves able to perform the tricks successfully for their own amusement.

BACKGROUND OF THE INVENTION

At. U.S. Pat. No. 5,445,565 issued 1995 to one of the present inventors Setteducati, describes a magic set comprising a series of props; a series of leaves or sheets having faces marked with indicia illustrating ones of scenes and trick elements of a magic show and interacting with at least selected props of the series of props in forming one of a trick and story line of the show; hinge means pivotally connecting the leaves along one edge for sequential presentation to an audience; and, indicia on successive leaves interacting directly to form one of a trick and continuous story line of the show.

However, in the prior magic set, it is first necessary for the person performing the tricks to understand the secret mechanisms underlying the trick routines and secrets prior to performance. As a result, the user is deprived of the elements of being surprised and fooled by the trick because he must first know the secret workings of the tricks to perform them. The prior magic set is therefore only suitable for presentation of tricks by an informed user adopting a magician's role to spectators.

There are some so-called forcing tricks that the spectator can perform himself and be deceived by the outcome but involve only mental mathematical trickery not an effect produced by physical or mechanical elements with a physical/mechanical result. An example is "The Nine Mystery" published in "The Magic Book" by Karl Fulves in 1977.

There have been mechanical pop-up type books with a magic as a theme, for example, "the Magic Show " by Richard Fowler and David Wood published 1995 by Hazar Publishing, London, but although these books involve mechanical members or props which can be moved by the user, they only simulate tricks and do not actually provide mechanical means for fooling or deceiving the user.

There is a need for a magic set by which uninformed users are themselves able to successfully perform and fool themselves with tricks for their own amusement simply by manipulating the props and trick elements according to the directions in the book without the underlying trick mechanisms/solutions to the tricks being necessarily revealed to the user either before, during or, preferably, after their performance so that the element of mystery is retained providing the user/performer with the enjoyable experience of a spectator.

SUMMARY OF THE INVENTION

According to one aspect, the invention provides a magic set comprising a series of props and a plurality of leaves having faces marked with indicia illustrating ones of scenes and trick elements of a magic show and complementary and interactive with at least selected props of the series of props in forming tricks of the show; hinge means pivotally connecting the leaves along one edge for sequential presentation; the improvement residing in that the leaves form a book and are provided with means for holding, movable props at predetermined different display locations on faces thereof and a prop moved by a user in accordance with the directions between different display locations on one face of a leaf in the performance routine of one trick mechanically interacts with one of trick indicia and a prop on an opposite face of the one leaf to determine an outcome of one of a same and another, previously initiated trick, while a portion of the prop which would reveal a solution to said one of a same and another trick remains undetected throughout performance of routines of both tricks performance so that an uninformed user is able to successfully perform tricks simply by manipulating the props and trick elements according to the directions, without solutions of the tricks being necessarily revealed to the user by the performance whereby an element of mystery is retained after the performance, so that the user/performer also has the enjoyable experience of a spectator.

DESCRIPTION OF PARTICULAR EMBODIMENT

Figure 1:
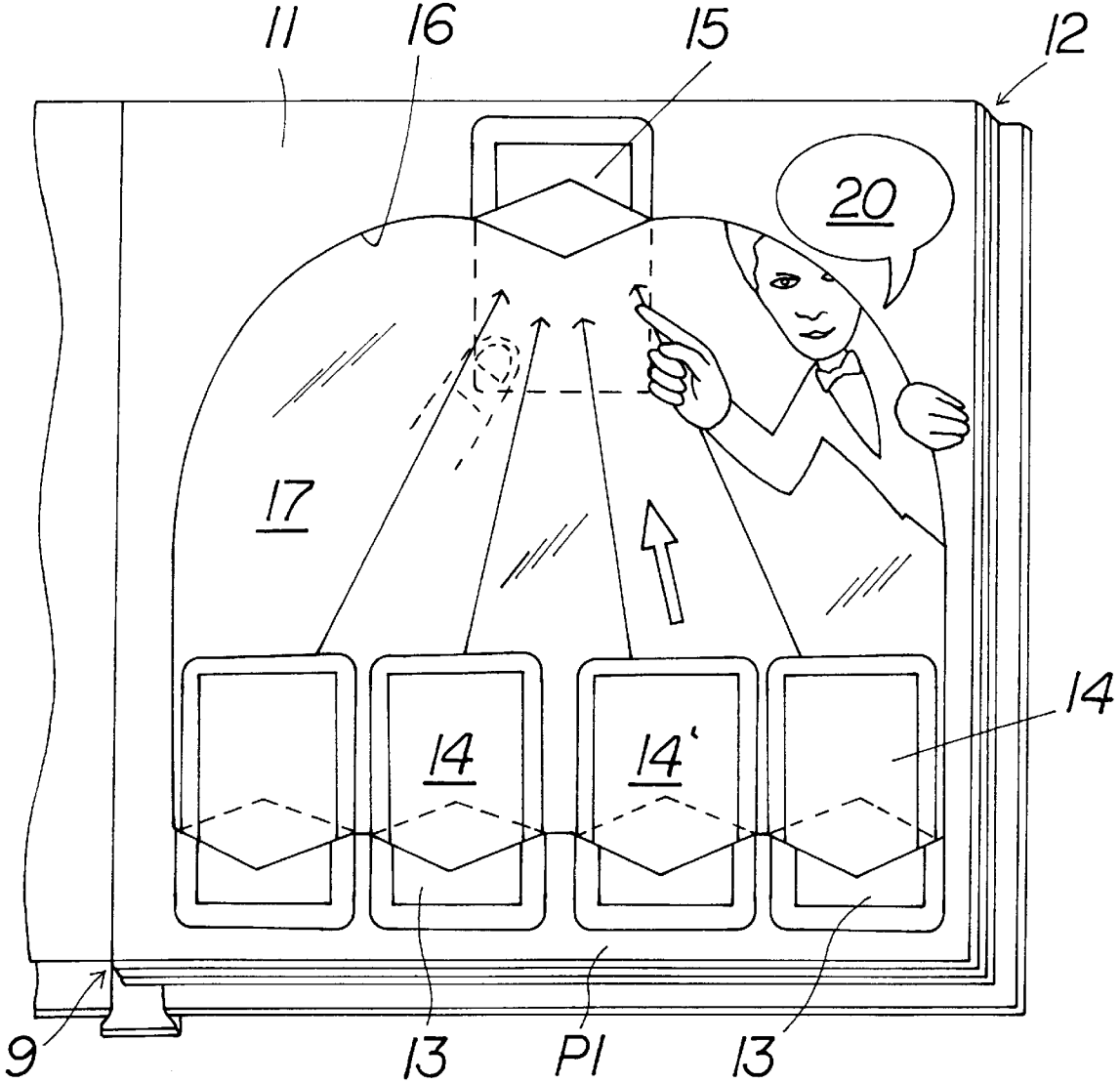
FIG. 1 is a perspective view of a book of magic open at a right side page at a start of a performance routine of a first trick with the opposite pages broken away.
Figure 2:
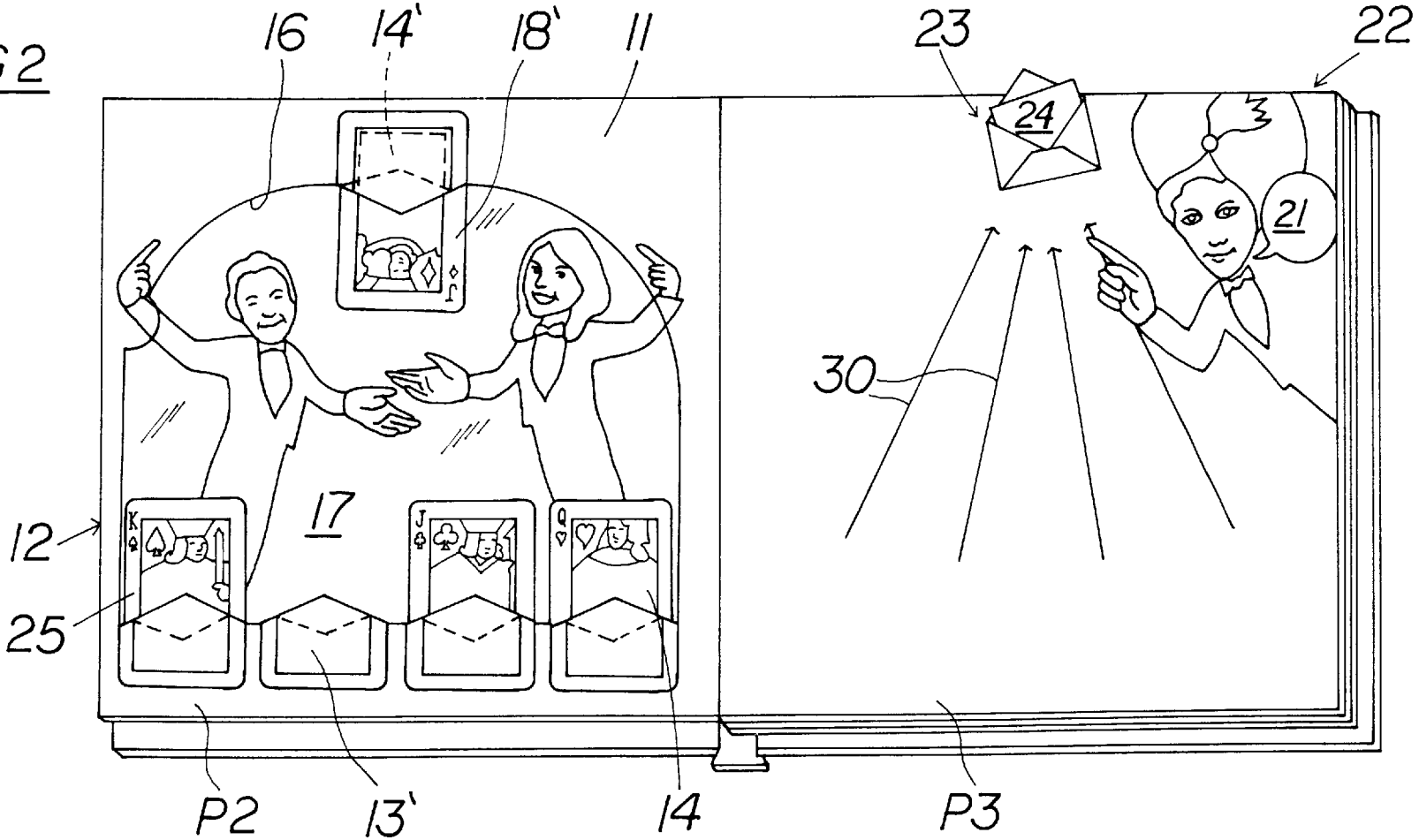
FIG. 2 is a diagrammatic isometric view overleaf, of the next two facing pages of the book showing the remainder of the routine for completion of the first trick.

In a first magic trick, shown in FIGS. 1–4, in which the book magician predicts the face value of a playing card selected by the user, face unseen, a first face 11, page P1, of a first leaf 12 (FIG. 1) on a right hand side of the open book, is provided along a bottom edge with a row of four upwardly opening pockets 13 retaining respective playing cards 14 face down and a single, downwardly opening pocket 15 at the top edge with a die cut window 16 covered by a transparent plastic window pane 17 extending between the pockets 13 and 15. The user follows the magician's direction in speech balloon 20: "Without turning it over, slide ONE card from below straight into this pocket, then turn the page", by sliding a selected card 14', face down, across the window pane 17, as indicated by the large arrow and turning overleaf to page P2, revealing, as shown in FIG. 2, only a lower portion 18' of the face of the selected card 14' retained in the top pocket 15 visible through the transparent window sheet 17 of the next page, as the Jack of Diamonds.

The user then follows the direction in the speech balloon 21 on the next, facing page P3 of the second leaf 22, adjacent a paper envelope 23 glued to the face: "Now open the envelope and read my prediction !", the user removes a paper/note 24 on which is written "Jack of Diamonds" —which corresponds to the lower portion, 18' of the selected card 14' visible through the window panel 17 on facing page 2.

Only upper portions 25 of the faces of the cards 14 remaining in the bottom pockets 13 are visible through the window on page 2, which portions have different values from the Jack of Diamonds completing the illusion that the value of the chosen card 14' has been predicted accurately from four different possibilities.

Figure 4:
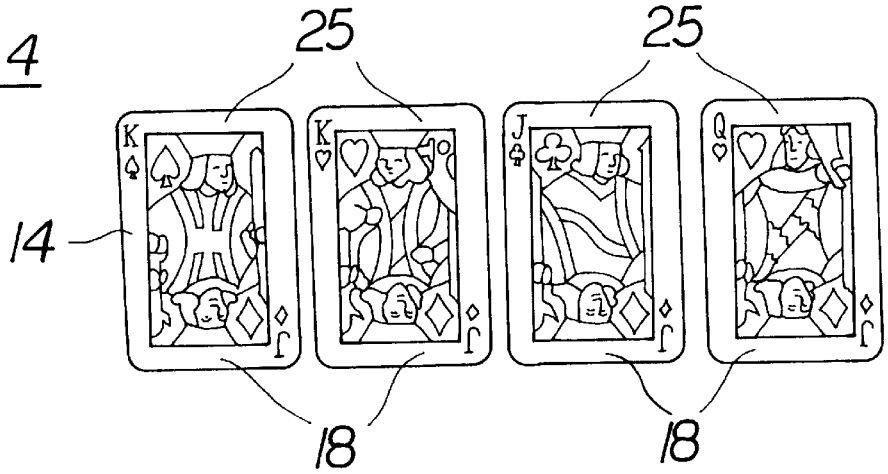
FIG. 4 is a plan view showing the faces of all the cards forming props of the first trick.

In fact, as shown in FIG. 4, the lower portions 18 of the faces of all four cards are Jack of Diamonds, so the result is inevitable. The upper portions 25 of the cards are all different while the lower portions 18 of the three cards remain covered at all times, prior, during and after trick performance. The upper portion of the selected card 14' also remains unseen, assisting in maintaining the illusion.

As, according to the directions in an booklet 112 attached to the last page, when resetting the trick, the user turns the first leaf back, returning to page P1, before sliding the selected card face down back across the plastic window pane into the vacant bottom pocket 13', the fact that the top portion of each card has a different value from the respective bottom portion will remain undetected and the mystery of the prediction will remain for the users even after they have performed the trick. As a repeat performance, selecting a different card would again result in the Jack of Diamonds, the secret/solution would probably be guessed by a reasonably astute user.

Figure 3:
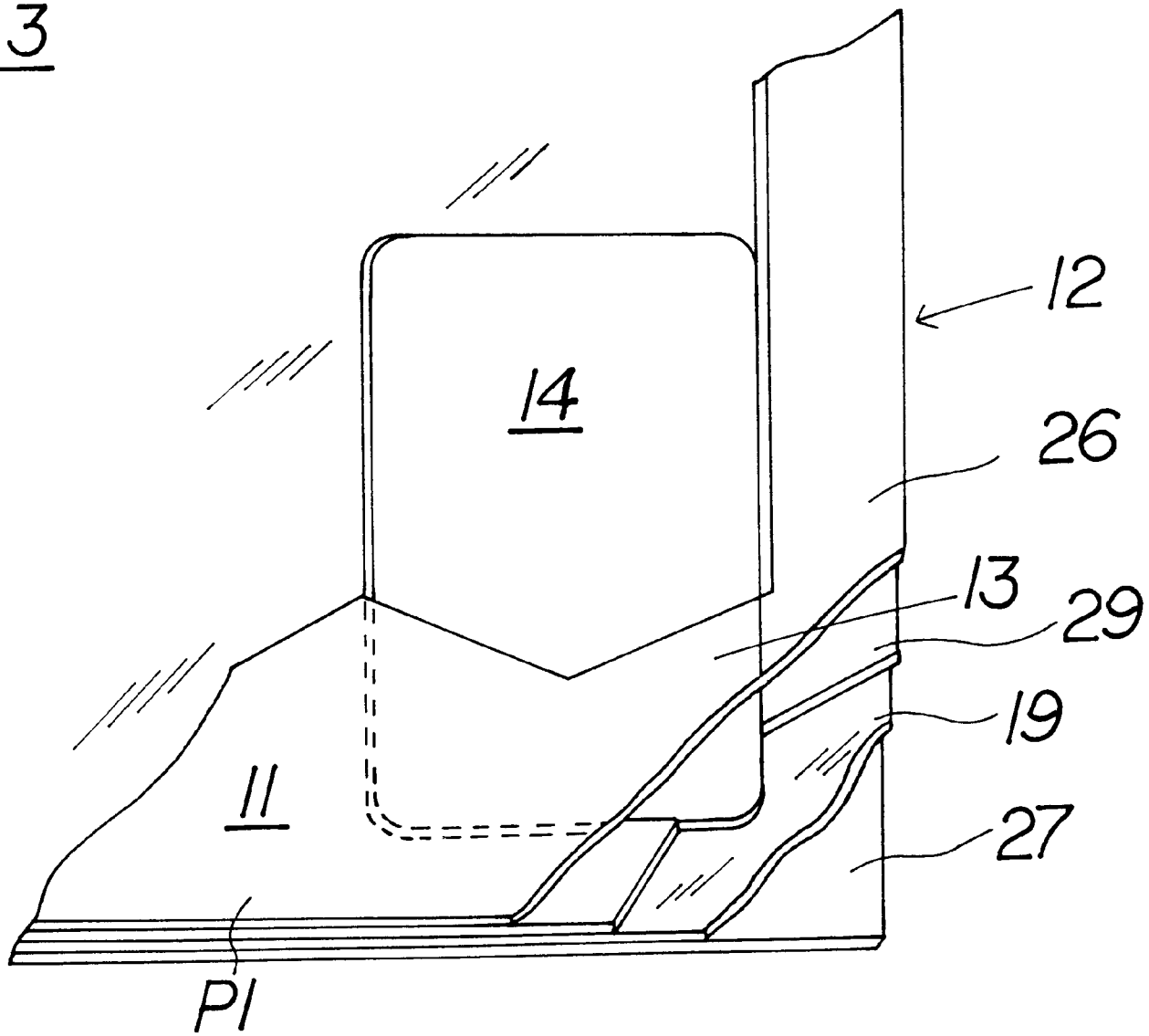
FIG. 3 is a fragmentary diagrammatic isometric of a corner portion of the first page showing the structure of the first leaf.

As shown in FIG. 3, the first leaf 12 comprises an acrylic sheet 19 trapped between first and second sheets of cardboard 26, 27, to form the pane 17 extending completely across the window which is die cut in both sheets. A pocket defining, spacing layer 29 is interposed between the first sheet of cardboard 26 and the acrylic or acetate layer 19 and has cut-outs forming the interior pocket profiles so that the first cardboard sheet 26, the acrylic sheet and the cardboard layer 29 define the pockets 14 and 15 between them. As the first sheet of cardboard 26 has pocket forming portions which are V-cut, at the start of the trick, on the first page, the user sees substantially more than 50% of the rear faces of the cards whereas, by contrast, the second cardboard sheet, forming the second, backing page of the same leaf, has corresponding pocket forming portions which are pointed, obscuring the transition region between indicia representing the Jack of Diamonds. However, as the page has been turned over, the user tends to retain the impression of having seen almost all the card, enhancing the illusion. Arrows (not shown) marked on the rear faces of the cards indicate the correct positioning for trick performance. Arrows 30, leading from respective pockets 14 to the pocket 15, indicating paths of movement of the cards are also marked on the third page P3 to be visible through the window at the start of the trick when viewing FIG. 1.

Figure 5:
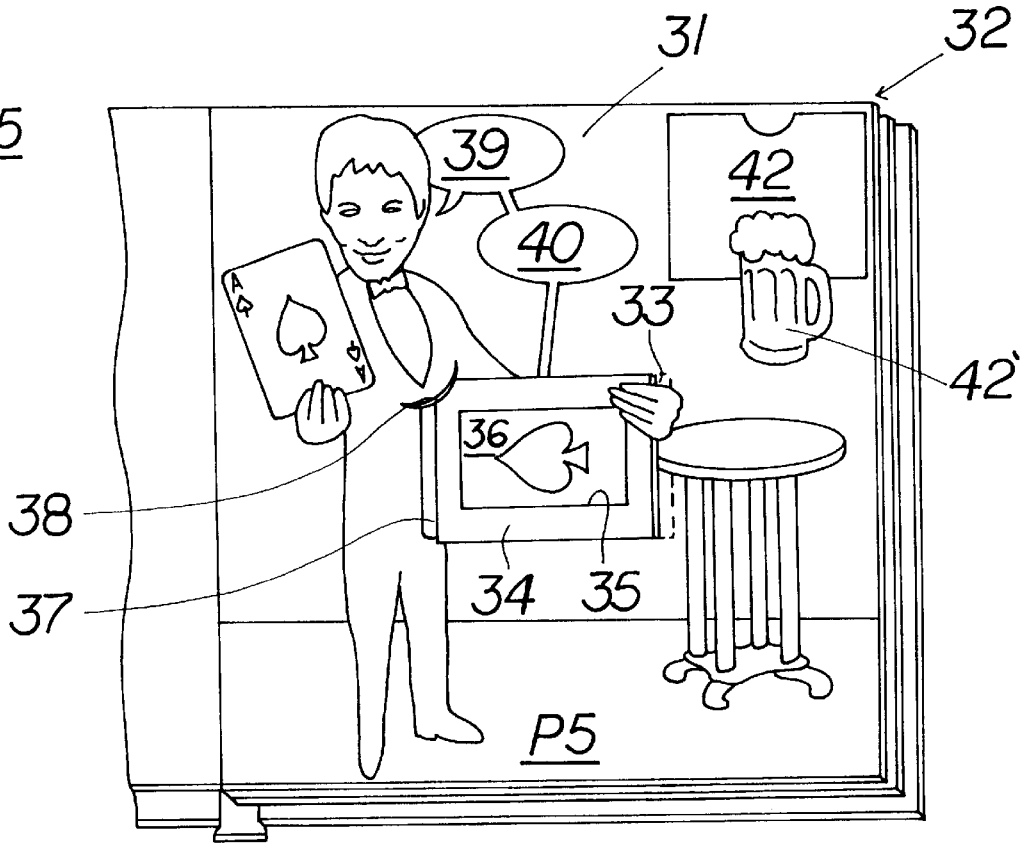
FIG. 5 is a diagrammatic isometric view of a right side page at a start of a performance routine of a second trick with the opposite pages broken away.

Referring to FIGS. 5, and 6A–6G, in a second trick, as shown in FIG. 5, a first face 31 of a leaf 32 forming a right hand page P5 displays indicia of a magician holding an Ace of Clubs in a right hand and, in the other hand, a hinged end 33 of a sleeve-form pocket or card holding frame with front and rear frame parts 34, 34' defining central, (apparently) and rear windows 35, 35' through which apparent front window 35, a central portion of what is apparently a face of a card 36 having the value of the Ace of Clubs can be seen with a free end 37 of apparently the same card 36 protruding out of the frame. The frame is retained in flat position on the face of the page by releasably tucking under a flap 38 cut in an upper sheet, forming page P5, of the two sheets forming the leaf 32, at location corresponding to a bottom of the magician's jacket. A first magician's speech balloon 39 contains the words: "I'm holding two aces—one in my hand, and one in the black frame". A second speech balloon 40 contains the direction: "Flip the black frame over to the right so that the Ace is face down".

Figure 6B:
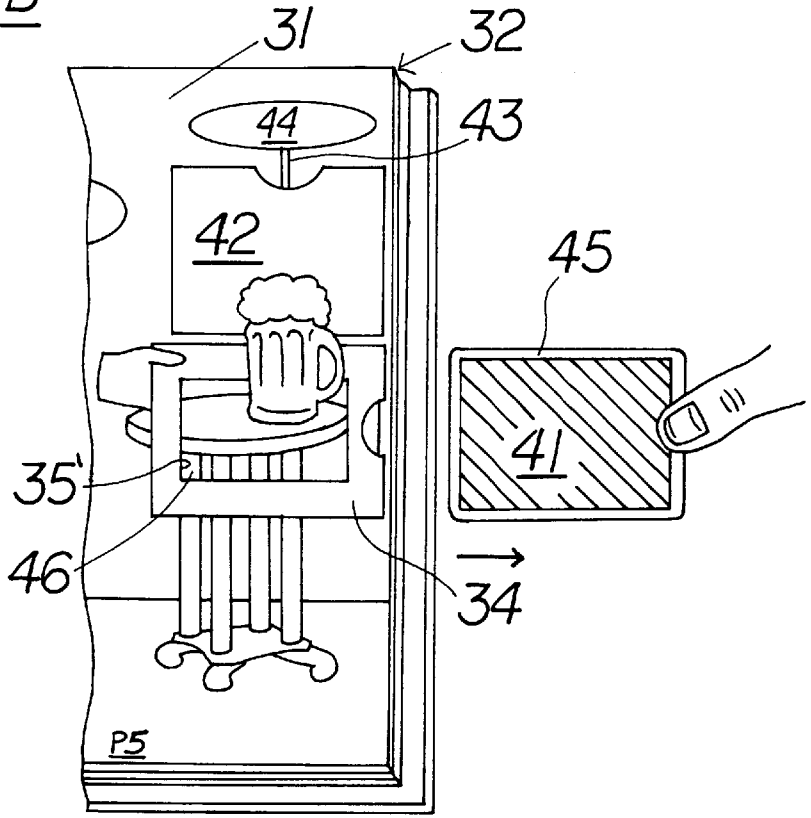
FIGS. 6*a* and 6*b* are, respectively, fragmentary diagrammatic isometric views of the right side page of FIG. 5 showing successive steps of the performance routine of the second trick.
Figure 6A:
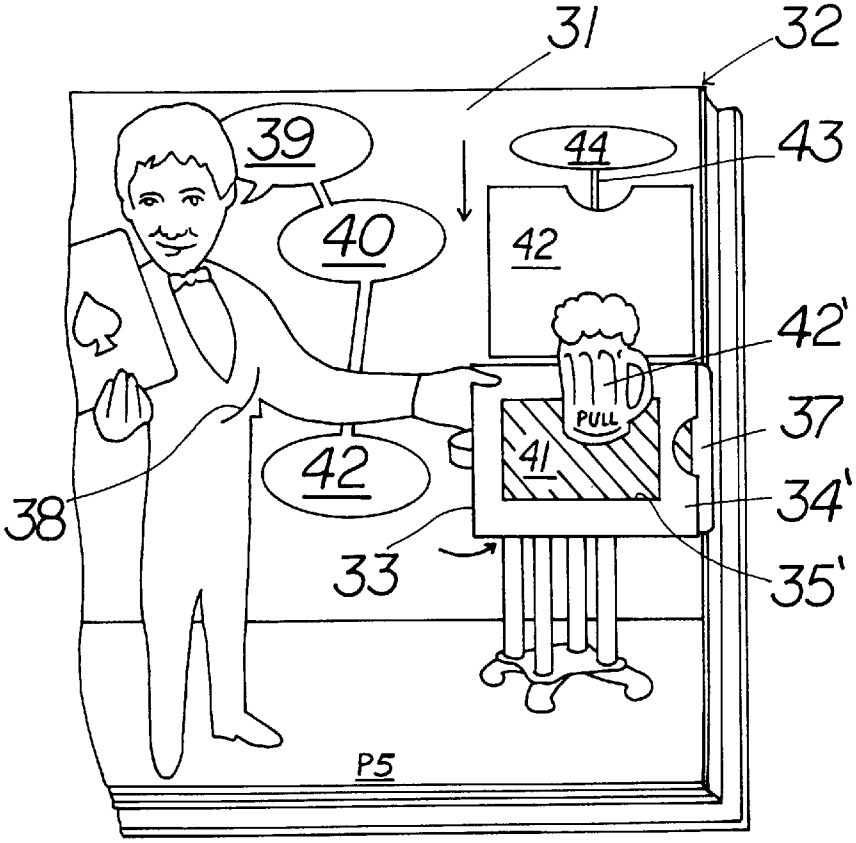

As shown in FIG. 6*a*, releasing the free end of the frame by raising the flap 38 and flipping the frame 34, 34' over about the hinged end 33 to the right, to a postion covering background indicia depicting a table, reveals through the rear window 35', the back 41 of what is apparently the same card 36 held by the frame and reveals another speech balloon 42, hidden by the frame 34 in the original position, containing the words: "Slide the beer mug down—all the way on top of the ace so that I can't move it".

As shown in FIG. 6A, pulling a panel form tab 42 having a fingerpiece 42' at a lower end marked with indicia depicting a beer mug and profiled accordingly, along a vertical mounting vertical slot 43 through the sheet, from the position shown in FIG. 5, down the page to extend over and trap the card holding frame, as shown in FIG. 6B, reveals a further speech balloon 44 containing the direction "Pull the ACE out of the frame and keep it FACE DOWN. Then turn the page→".

As shown in FIGS. 6A and 6B, pulling the exposed free end 37 draws a single card 45 out of the frame progressively exposing, in the frame window 35', indicia depicting a portion 46 of what appears to be the same background table 47 depicted by indicia on the face of the page and now underlying the frame, providing the illusion that the frame has been emptied by removing the card 45.

Figure 7:
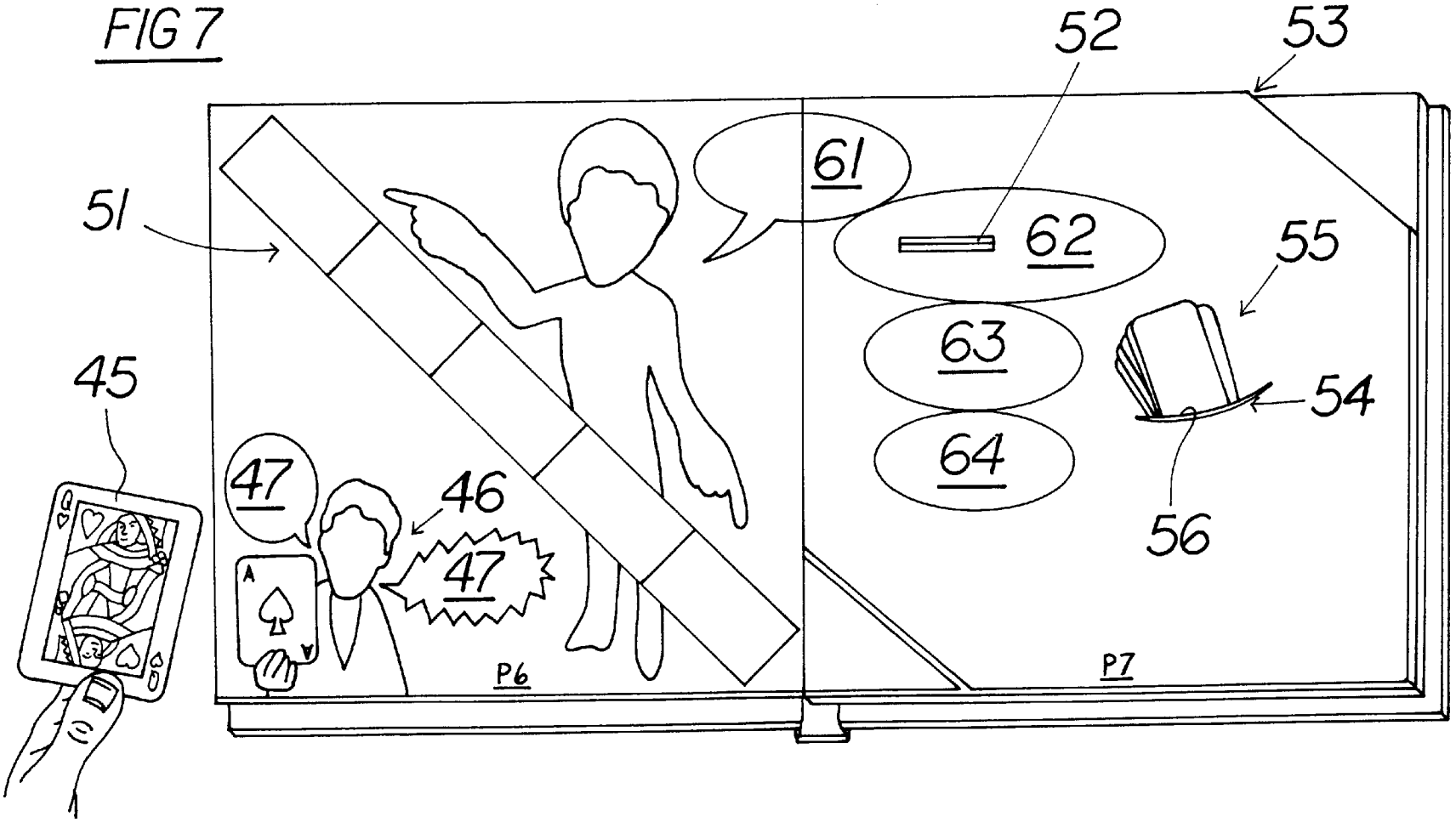
FIG. 7 is a diagrammatic isometric view overleaf, of the next two opposed pages of the book showing the remainder of the routine for completion of the second trick and the start of the third trick.

As shown in FIG. 7, turning the page, reveals, overleaf, the face of the previously underlying sheet of the same leaf, forming page P6 marked with indicia 46 inset adjacent the lower left hand corner depicting the magician holding up the Ace of Spades and a first speech balloon 47 carrying the direction: "OK . . . NOW TURN OVER YOUR ACE . . . " and a second speech balloon 48 announcing: "BLACK-JACK". Turning over the card 49 withdrawn from the frame reveals, not the Ace Of Spades, but the Queen of Hearts, completing the "BLACKJACK".

Figure 6D:
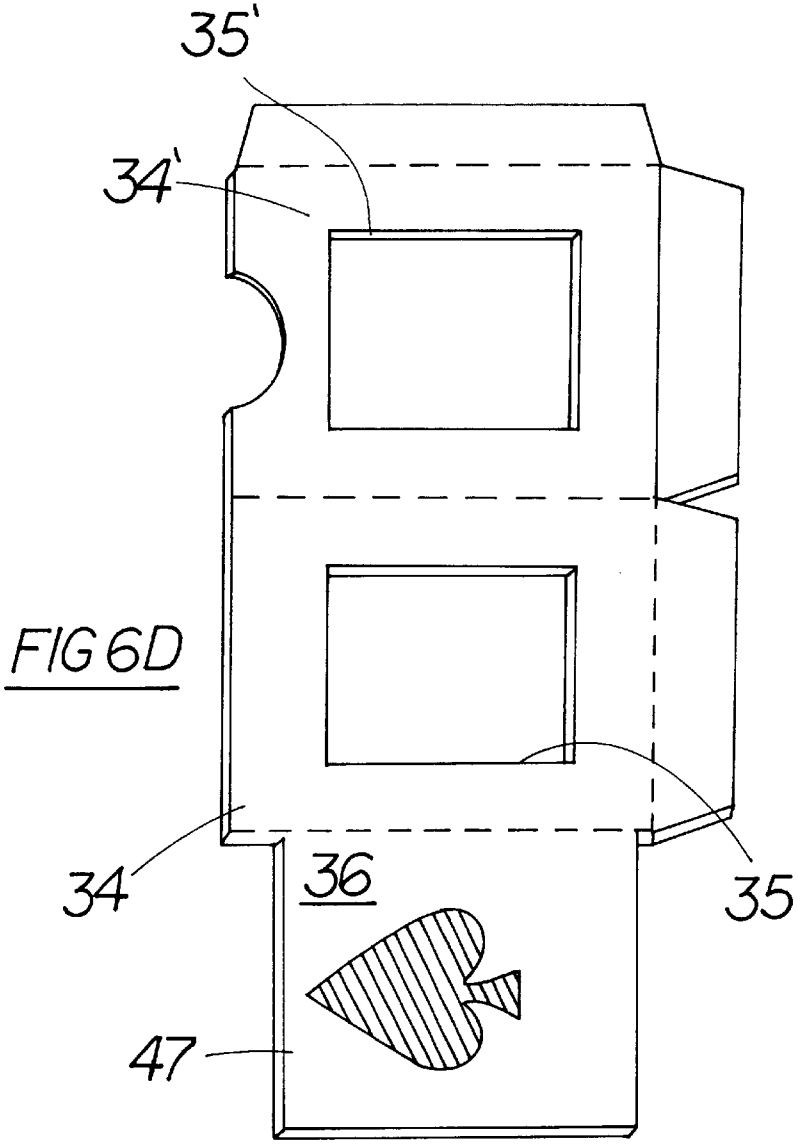
FIGS. 6*c* and 6*d* are, respectively, enlarged elevational view of the pivotal card holding frame of FIG. 5 and a plan view of blank from which card holding frame is formed, respectively.
Figure 6C:
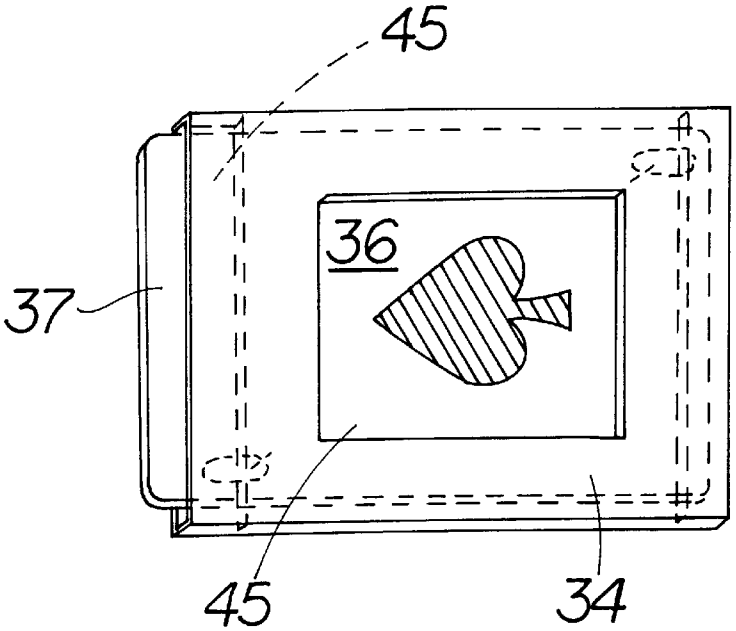

As shown particularly in FIGS. 6C and 6D, the frame window 35 is not open to display the value of a card therein but closed by a panel 47 glued to the inside of the frame and marked on the initially exposed face with indicia depicting the Ace of Spades and, on the other face 46, with indicia depicting a corresponding portion of the table. The card 45 is premounted in the frame with the card face against the panel 47. The card holding frame is formed by folding the panel 47 about the adjacent fold line through 180 degrees against the inside surface of the frame part 34 and gluing thereto so that the indicia representing the ace of spades appears in the window 35 and then folding over the frame part 34' and folding and securing the flaps thereto to define the pocket.

The card holding frame is hingedly attached to the page simply by transparent adhesive tape or, alternatively by receipt of a tab forming an integral web hinge inserted in a slot formed in a first of two sheets forming the leaf a anchored within the leaf, between the sheets.

The leaf comprises two cardboard sheets secured together but remaining separated at least under the tab structure to permit sliding movement of an anchoring portion of the tab structure. The movement of the beer mug over the frame can assist in providing the impression to a spectator that the card and frame are secure from external interference.

Figure 6F:
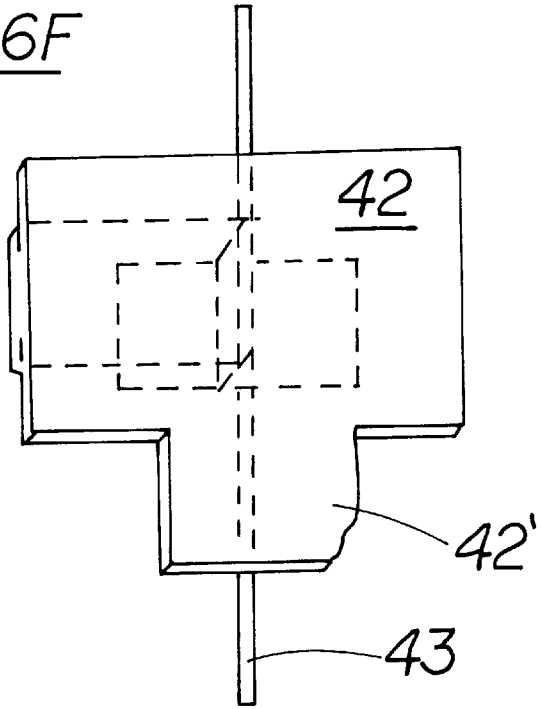
FIGS. 6*e*; 6*f* and 6G are, respectively, enlarged schematic isometric and plan views of a sliding tab shown in FIG. 5, and a plan view of of a blank from which the sliding tab is formed.
Figure 6E:
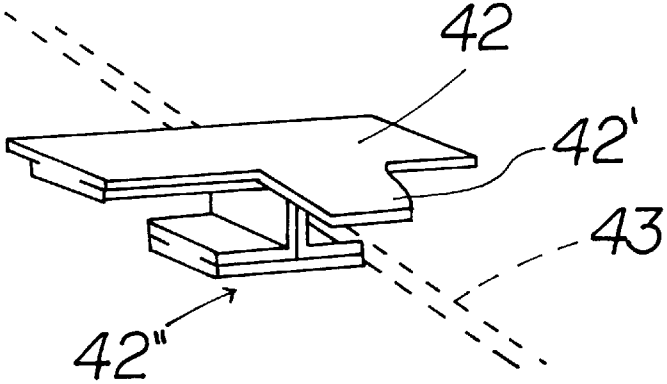
Figure 6G:
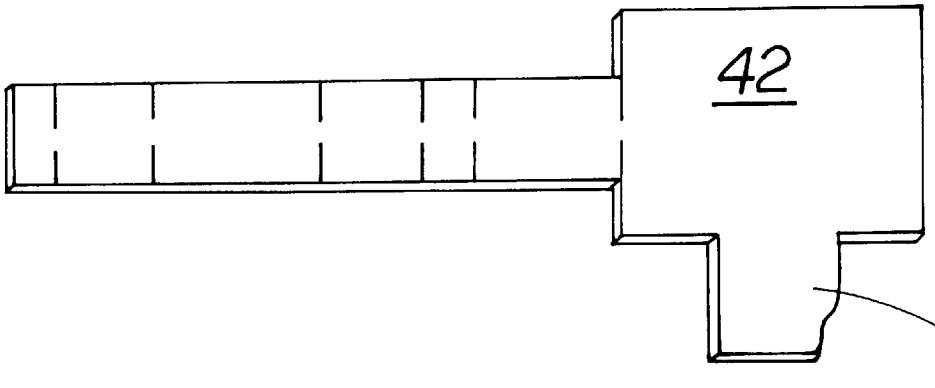

As shown schematically in FIGS. 6E–6G, the sliding panel-form tab 42 is formed by folding a one piece piece blank, shown schematically in FIG. 6G to provide a generally I-shape with the upright anchored in the slot 43 by a transvers base part 42'' trapped between the two sheets forming the leaf.

In the third trick, shown in FIGS. 7–10 in which the value of a domino is predicted by the magician, the same face of the leaf forming a left hand page P6 is marked with indicia depicting a diagonal row of five frames 51 for receiving respective dominoes in end to end relation. A slot 52 is formed completely through the sheets forming the next, opposite leaf 53 and a pocket depicted as basket (not shown) 54 containing a bunch of six domino cards 55, face down is formed by a slot 56 cut through the sheet forming page P7 formed by a first of two cardboard sheets forming the next leaf. A series of linked speech balloons 61–64 emanate from indicia depicting the magician, a first speech balloon reading: "Now for more EXPERT magic with my DEVIOUS DOMINOES trick !" and "Take the domino cards from Ivan's basket and shuffle them face-down". A second linked speech balloon 62 surrounding the slot 52, carries the direction: "Slide one domino face down into this slot until it disappears." Subsequent linked speech balloons 63, 64 read: "Arrange the rest of the dominoes FACE UP in these spaces so they all match end to end"; and, when the matched row is complete, please turn the page."

Figure 8B:
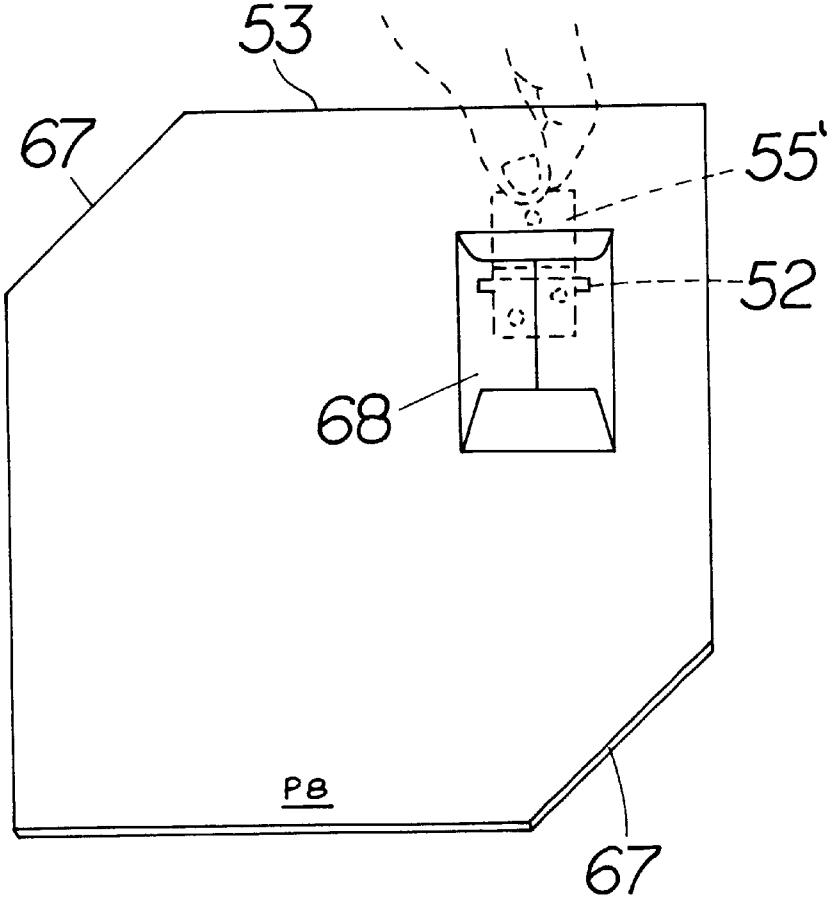
FIGS. 8A and 8B are schematic views of opposite pages P7 and P8, being faces of the two sheets forming the next leaf showing insertion of a card through a slot in the leaf into an envelope on page P8.
Figure 8A:
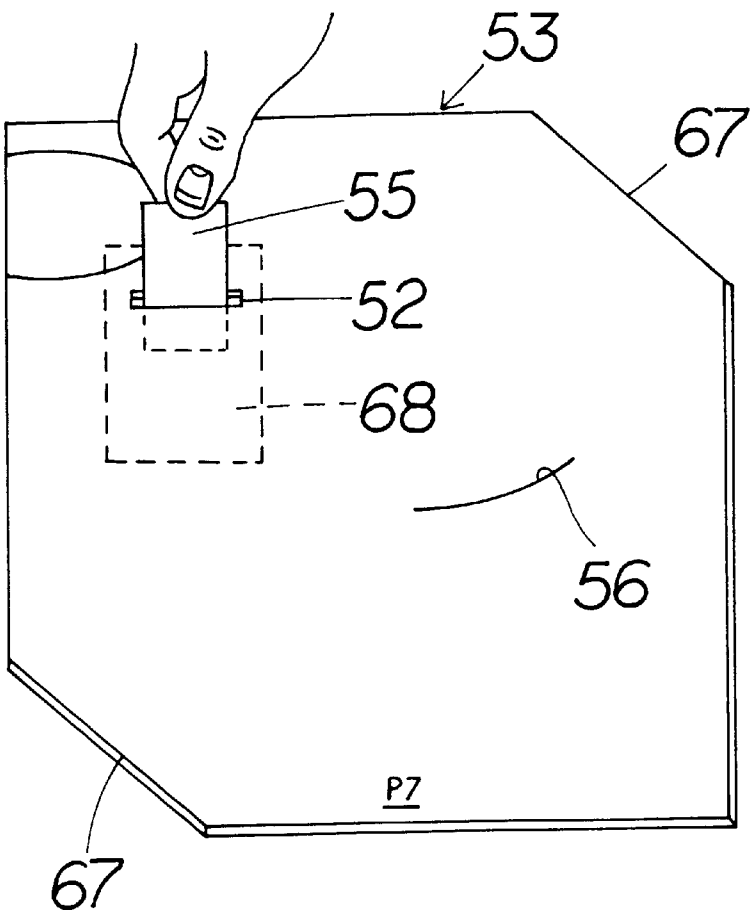
Figure 9:
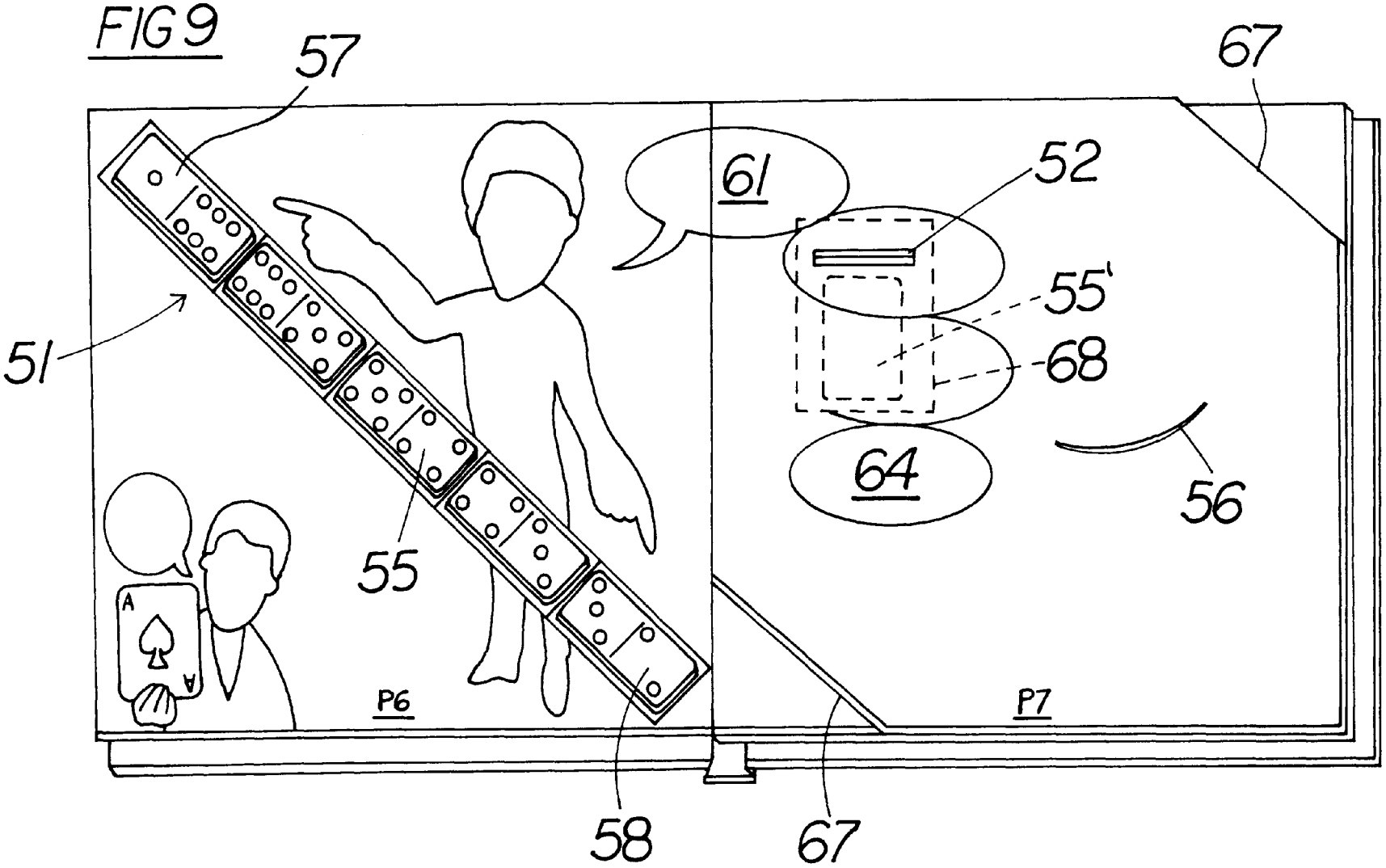
FIG. 9 is a diagrammatic isometric view of the pages shown in FIG. 7 at a subsequent stage of the performance routine of the third trick.

Following the instructions in the speech balloons, the reader inserts a domino 55' into the slot as seen in FIGS. 8A and 8B, and arranges the remainder 55, as shown in FIG. 9.

Figure 10:
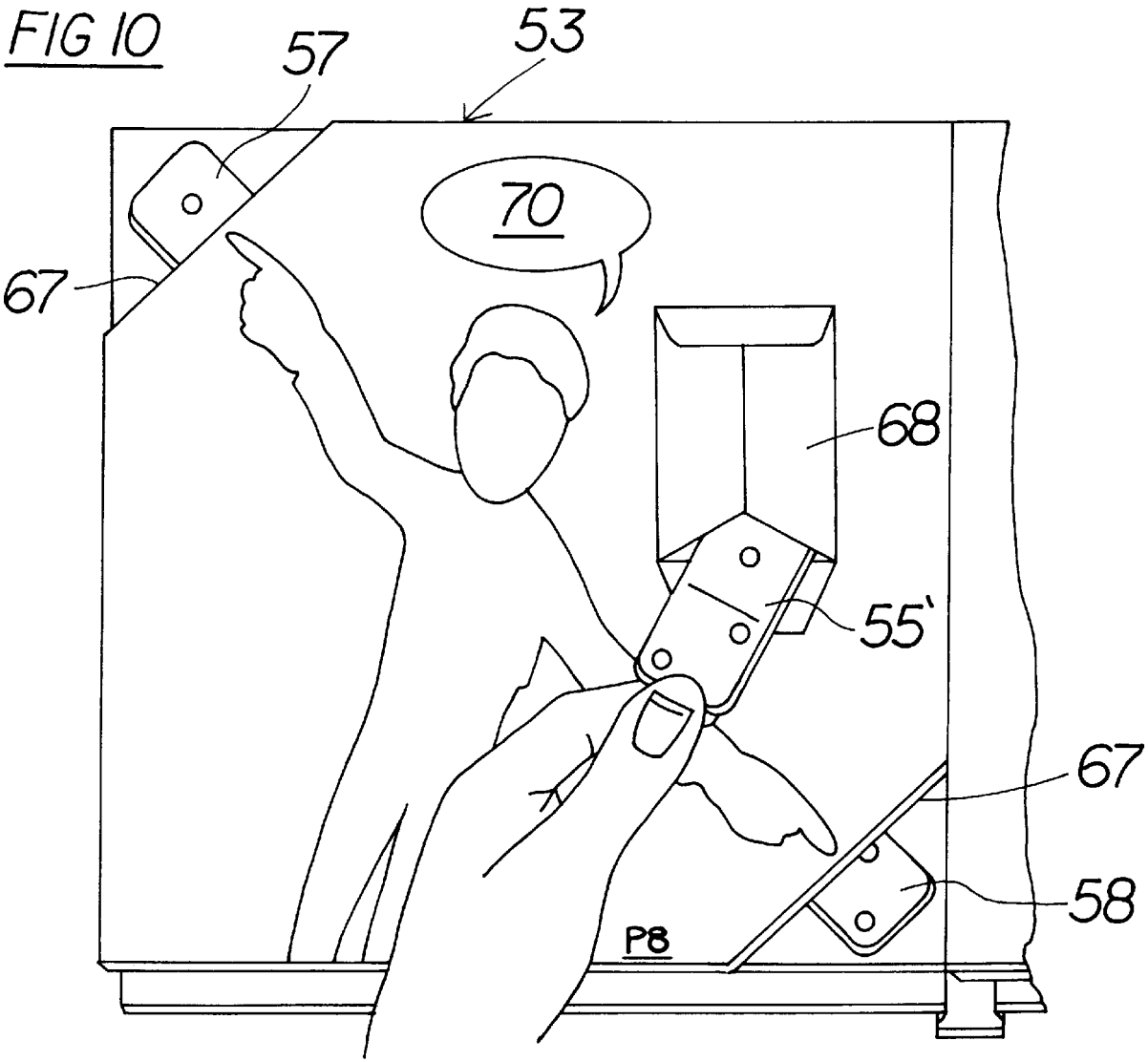
FIG. 10 is a diagrammatic isometric view overleaf, of a left hand page at a final step of the performance routine of the third trick.

The leaf 53 forming right page P7, has a pair of opposite diagonal corners 67 removed so that following the directions and turning the page, as shown in FIG. 10, reveals the endmost domain values 57 and 58 of the row exposed by the cut outs and an envelope 68 secured to the left hand page over the slot 52.

As shown in FIG. 10, speech balloon 70 emanates from indicia depicting the magician pointing to the cut outs carries the directions: "Notice the two ends of the domino row I'm pointing to . . . I've already predicted what they would be ! Open, the envelope please ! Opening the envelope reveals that the domino 55' inserted through the slot 56 has the same values as the two exposed ends 57,58 of the row of dominoes on the first sheet.

Careful examination of all the dominoes will reveal that whichever domino is removed from the bunch and inserted into the slot, when the remainder are matched end to end, the removed domino result will be the same values as the two exposed ends of the row of dominoes. As all but the endmost two values of the row of dominoes is concealed by the turned over page, the user will normally have forgotten those values and will not be able to determine the solution to the trick by casual inspection. Furthermore, the user often forgets that he himself has inserted the domino 55' in the slot, as a result of the intervening distracting activity of arranging the remaining dominoes on the spaces and, in addition, is not aware that inserting the domino into the slot also places the domino in the envelope, as the latter is concealed on the underlying next page during the act of insertion, and the association of envelope and slot may not even be made at the end of the trick in view of the distracting intervening activity.

A domino trick of the type in which dominoes have sequential numerical values selected to provide a "number loop" giving the same result by removing one domino is prior art, but the structure disclosed herein enabling self performance of such trick is new.

Figure 11:
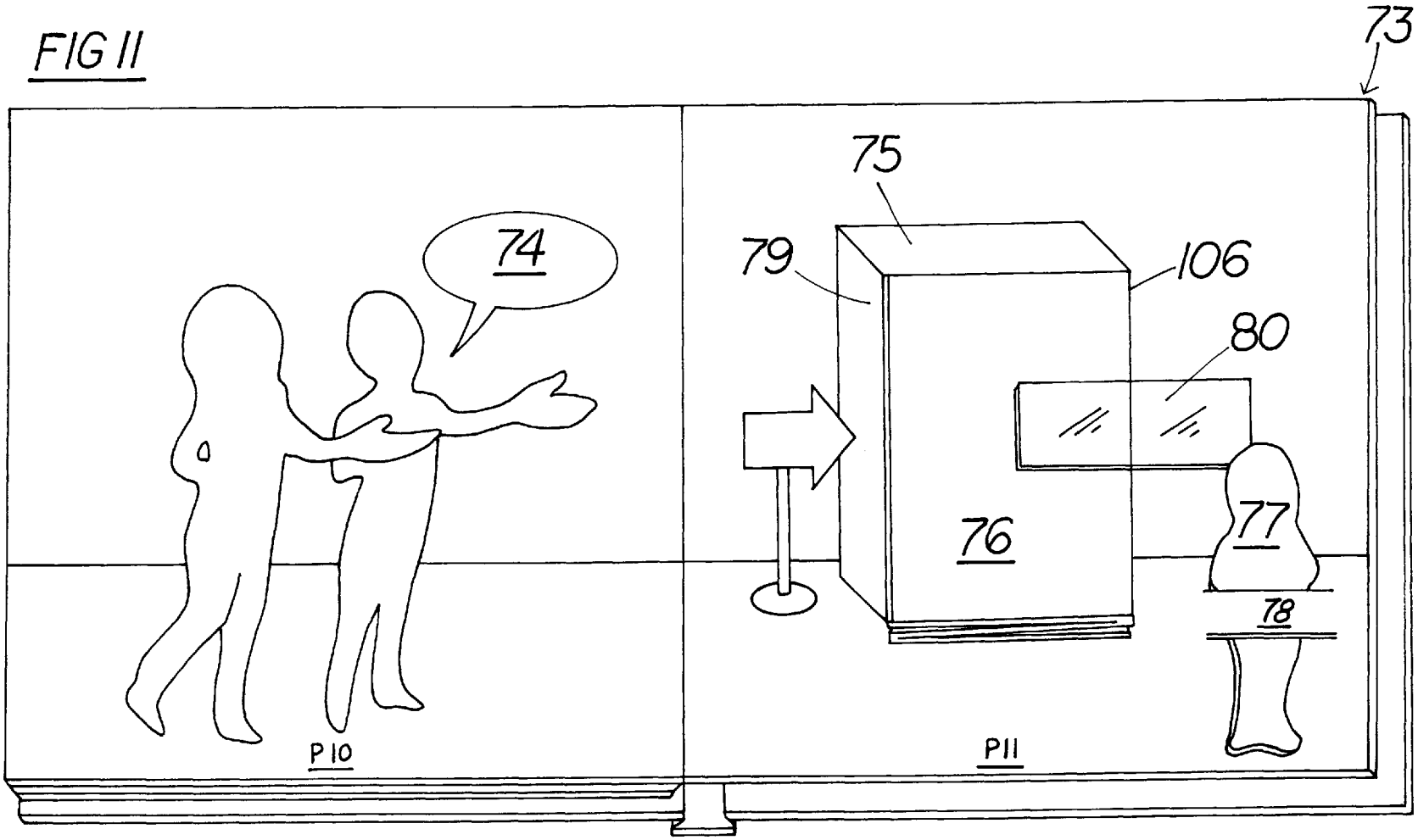
FIG. 11 is a diagrammatic isometric view of two subsequent facing pages P11 and P12 showing the starting point of a performance routine for a fourth trick.
Figure 12:
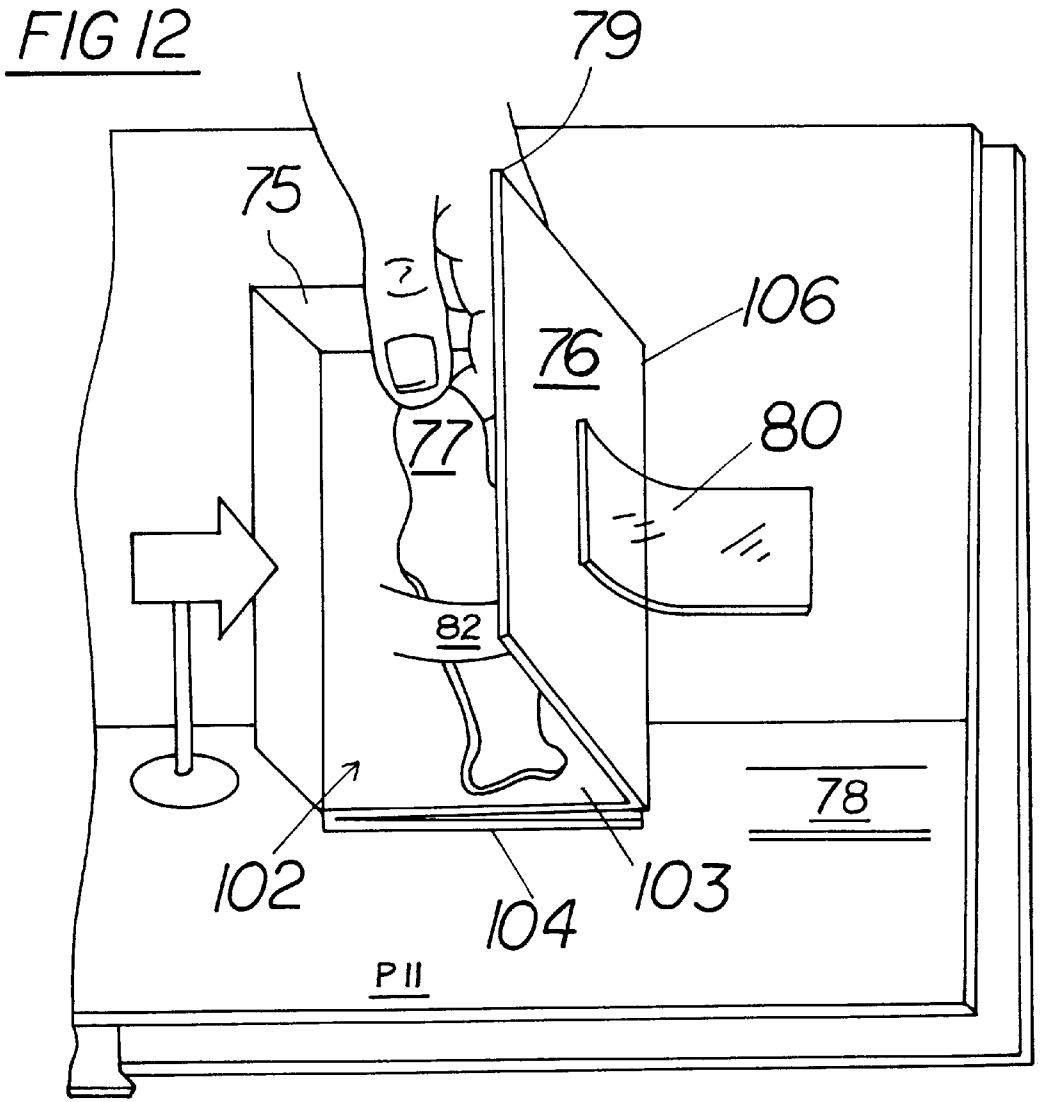
FIG. 12 is a diagrammatic isometric view of the right hand side page P 11 of FIG. 11 showing the next step of the performance routine of the fourth trick.

In a fourth trick, in which the magician is an escapologist, having initial steps shown by FIGS. 11 and 12, a page P 10 of a leaf 72 on a left hand side of the open book has indicia depicting another magician pointing to a second, facing, page P 11 on the right hand side leaf 73, and his speech balloon 74 directing: "Take Mark from below and place him securely in the chains inside the trunk. Then close the door. He must free himself within 3 minutes or he will run out of air ! Now turn the page and go to the next trick . . . "

Figure 13:
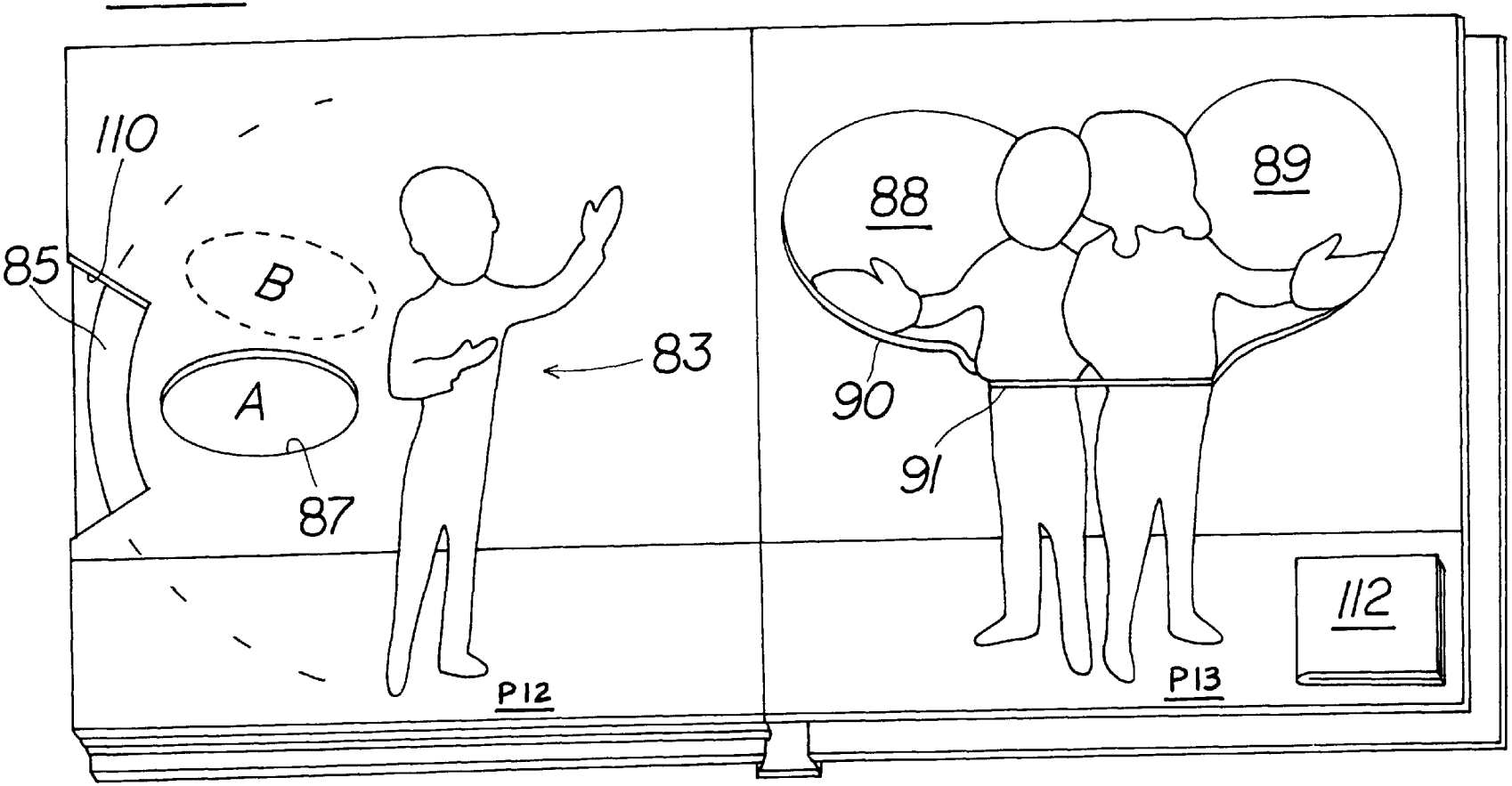
FIG. 13 is a diagrammatic isometric view overleaf, of two subsequent facing pages P 12 and P 13 showing the starting point of a performance routine for a fifth trick.
Figure 14:
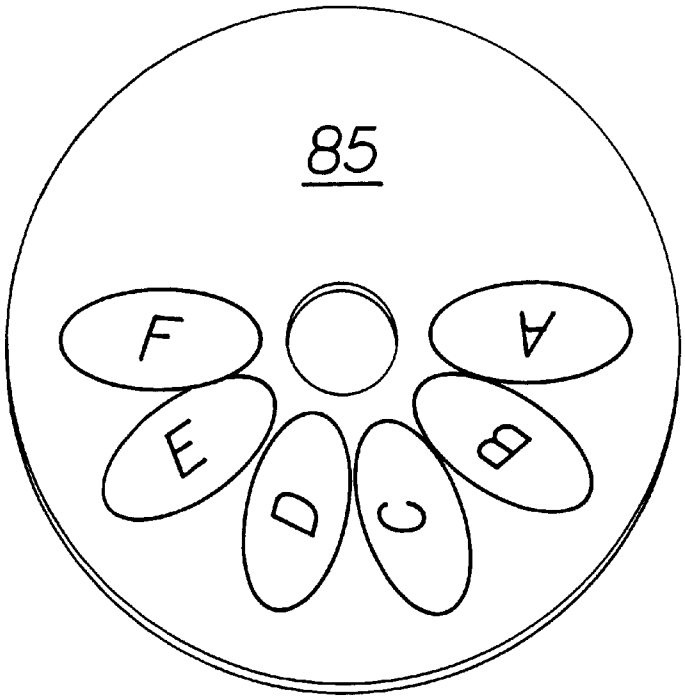
FIG. 14 is a diagrammatic isometric view of a wheel turned in the performance routine of the fourth and fifth tricks.
Figure 15:
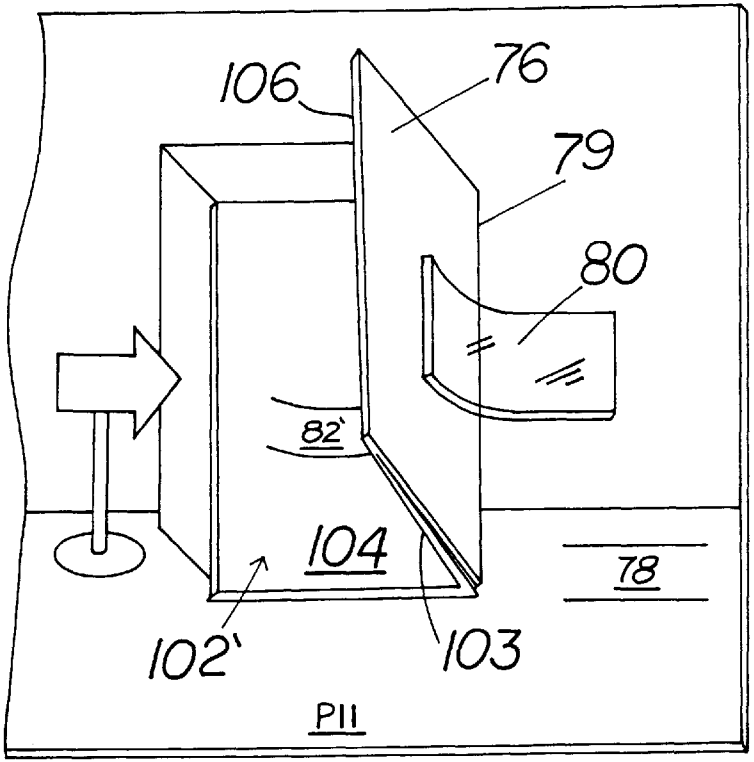
FIG. 15 is a fragmentary diagrammatic isometric view of the right hand page P 11 shown in FIG. 13 but at a penultimate step in the performance routine of the fourth trick.

As shown in FIG. 11, on the opposite page P 12, a trunk outline 75 is depicted and a hinged flap door 76 biassed closed by a clear plastic strip 80 is mounted thereon. A loose-piece cut-out 77, depicting Mark, the escapologist magician, bound and gagged is removable retained in a strap 78 defined between parallel slots cut into the upper of the two sheets forming the leaf. As shown in FIG. 12, the user removes the magician 77 from the strap 78, raises a free end 79 of the door flap 76 indicated by a sign 81 "OPEN HERE" and places the magician inside, in a strap 82, also defined between parallel slots, surrounded by indicia depicting chains and turns overleaf to the next, previously underlying, page P12, formed by the second sheet of the leaf by shown in FIG. 14 which reveals indicia 83 depicting rival magician Ivan giving directions in speech balloon A for performing a magic number trick by rotating a thumb wheel 85 to bring a series of calculating instructions B–F (FIG. 14) and final result sequentially into a window 87, die cut in the sheet forming page P 12, as shown in FIG. 13. The result indicia are associated with an instruction to "Turn back and check the trunk". On turning back to page P 11, and raising what appears to be the same free end of the unmoved, door flap 76, as shown in FIG. 15, the user find that the chains remain but magician Mark has disappeared. The underside of the door flap 76' now reveals the announcement (not shown) "The show is over. Turn to the last page"

On turning the leaf forward again, the user notices indicia on the right hand page P13 depicting the magician Ivan and the assistant Anne with speech balloons 88 and 89 from magician Ivan and assistant Anne exclaiming: "Mark has escaped, but where is he? I guess the show is over" and "Thank you and good night ! Pull us down to make us bow". The indicia depicting upper body portions of Ivan and Anne are marked on a flap 90 attached by a horizontal hinge 91, (such as clear adhesive tape or a tab in slot structure), to the face of the sheet.

Figure 18:
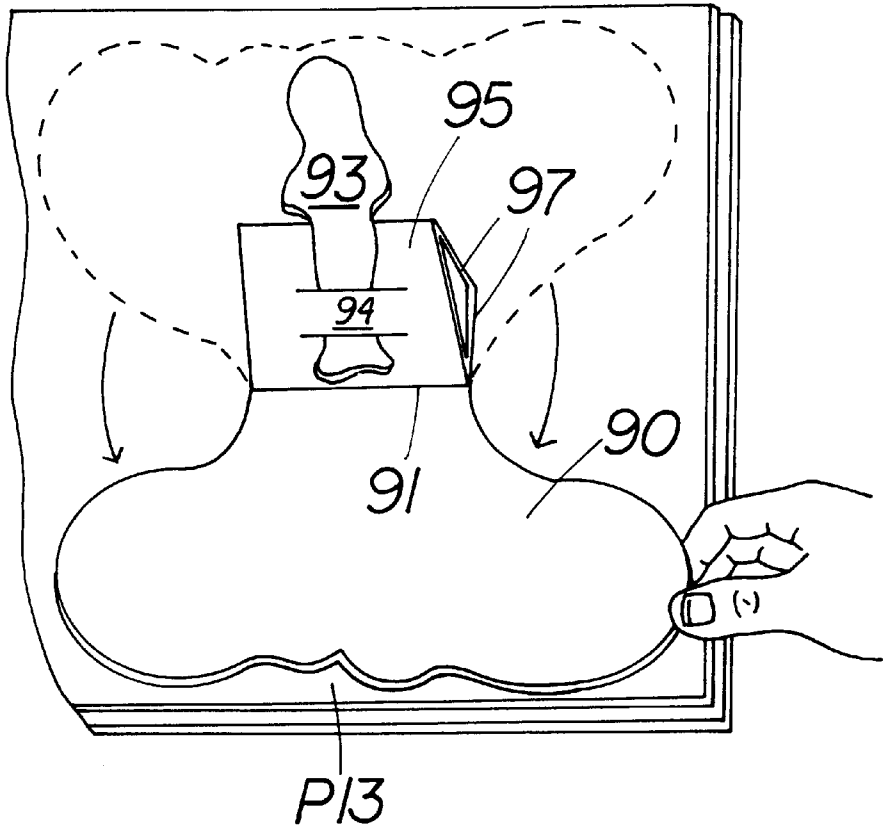
FIG. 18 is a diagrammatic isometric view of the right page of FIG. 14 at the final stage of the fourth trick.

As shown in FIG. 18, flipping down the flap 90 reveals an identical cut-out 93 of the magician Mark supported in a strap 94 defined between parallel slots in a front panel 95 of a triangular pop-up structure 96 having hinged backing portions 97 biassing return and behind the bowing backs of magician Ivan and assistant Anne, with speech balloons "SURPRISE !!! I'm alive!! You can't get rid of me THAT quickly !! Admit it, you couldn't have done the show without me! THE END ! The spectator therefore believes that the cutout of the magician Mark has been magically moved from the trunk to the last page.

Figure 17:
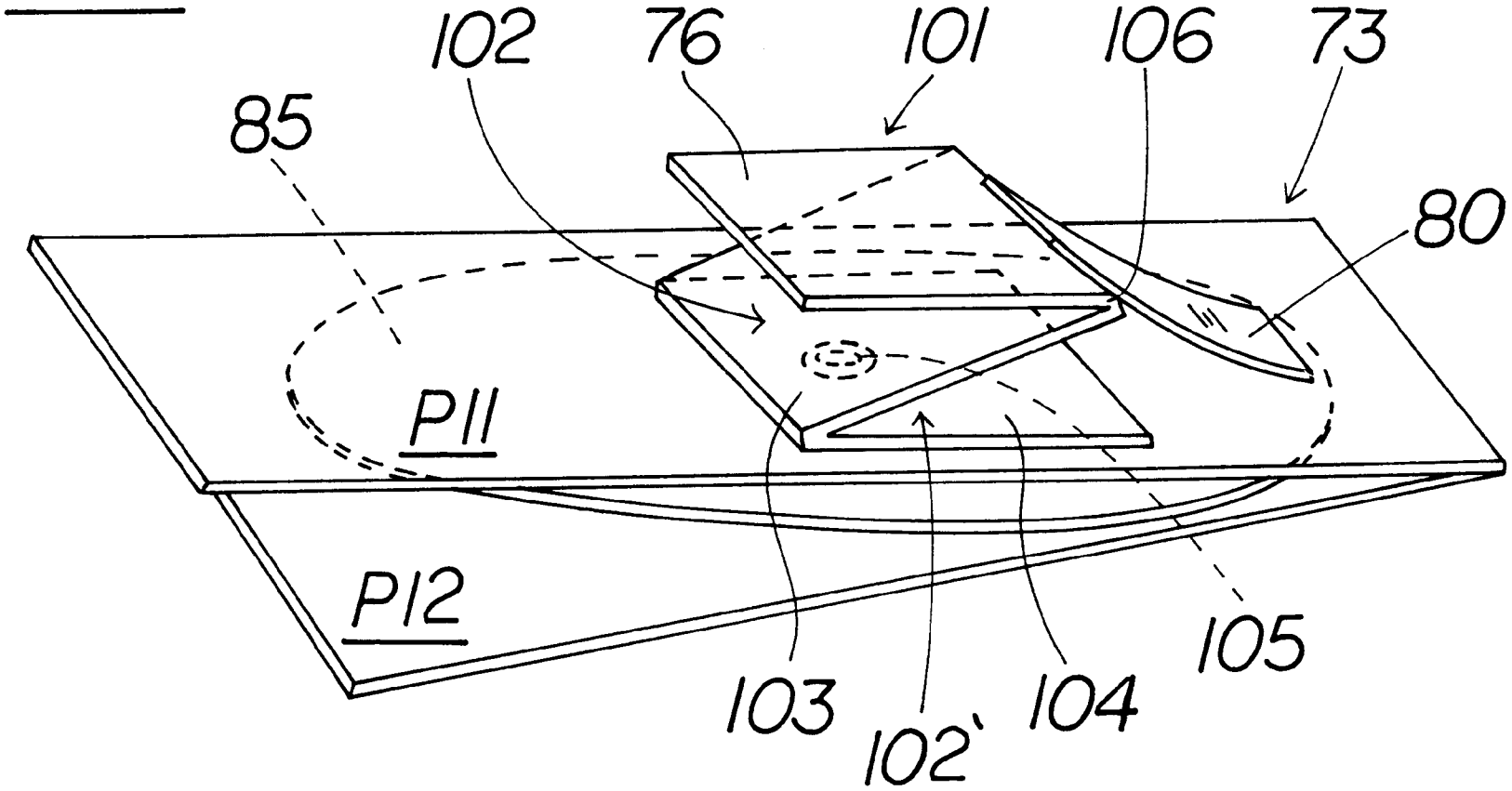
FIG. 17 is a fragmentary diagrammatic isometric view partly broken away showing the structure of the wheel and trunk mechanisms of the fourth and fifth tricks.

As shown in FIG. 17, the trunk door comprises a stiff paper/card sheet 101, bi-folded into a Z-section to provide two, discrete compartments 102, 102' which open in opposite directions and are defined between a center panel 103 and outer panel forming the trunk door 76 and the center panel and an inner panel 104. The inner panel 104 is rotatively mounted in the sheet forming page P11 for movement by the number wheel by any suitable conventional means such as by a rivet 105 rotatively received in an aperture in the sheet and securing the panel to the number wheel 85, (or by a card disk rotating within a circular aperture cut in the sheet forming page 11 and adhesively secured to the number wheel), rotatively mounted between the two sheets of leaf 73.

Figure 16:
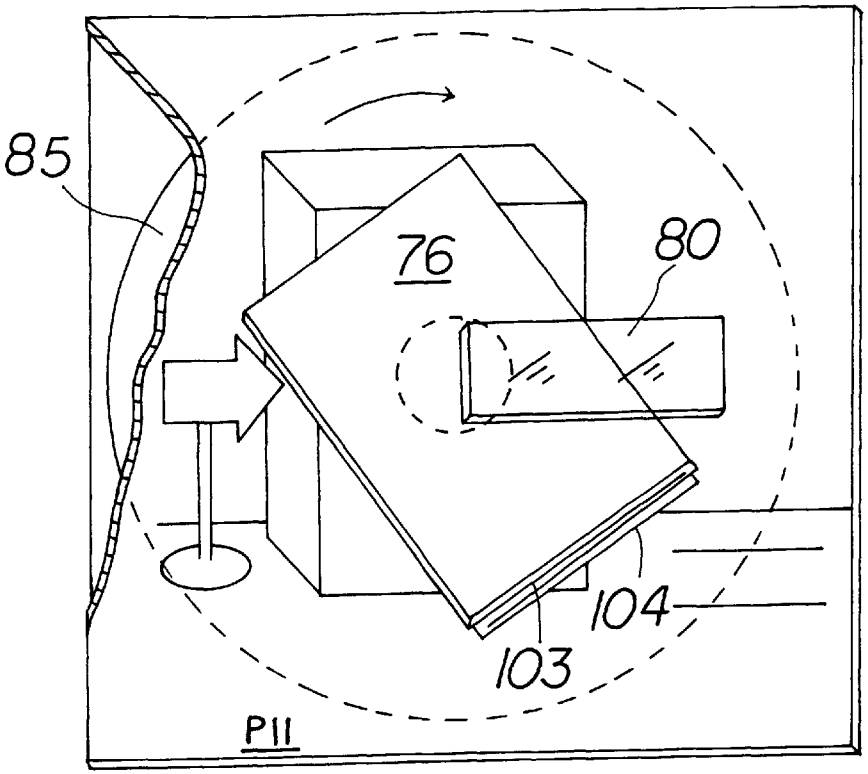

With the trunk door 76 (and sheet 101) in the first position corresponding to the starting rotational position of the number wheel a shown in FIG. 11,12 and 17, the user initially places the cut-out magician 77 into the first compartment 102. Unknown to the user, rotation of the wheel 85 to bring successive instructions into alignment with the window 87, for performance of the magic number routine, also rotates the bi-folded sheet through 180 degrees, as shown in FIG. 16 bringing the opening to the second, empty compartment 102' into the position formerly adopted by the opening of the first compartment 102, so that when the door 76 is raised a second time, a second compartment 102' identical to the first will be revealed as empty, providing the illusion that the magician has disappeared.

It should be noted that indicia with bilateral symmetry is marked on the flap door so that the rotation through 180 degrees cannot be detected by the user, while the indicia on the walls of the two compartment are identical. Although the edge of the door 76 and the panel 103 forming the opening to the second compartment are joined by a fold line 106, such structure is not apparent to the casual observer, particularly as the free end of the door flap is held against the face of the page by the resilient retaining strip 80 of clear plastic while permitting rotation of the door flap thereunder.

The thumb wheel portion of wheel 85 is exposed only to page P12 by a cutout 110 and concealed from view both before and after performance of the magic number trick by the material of the preceding sheet.

The disconnection between the wheel movement and the trunk is enhanced by the distraction following from the concentration required for the magic number and changing scenes during wheel rotation.

The wheel can be secured for rotation by a rivet or washer or a pivot piece formed by a cardboard disk slightly thicker than the wheel material and received in the aperture therein permitting free sliding rotational movement of the wheel between the two sheets of the leaf.

All leaves are formed by two sheets of cardboard material and, in one mode of manufacture, all the pages forming the book are formed from a single strip scored transversely to provide a series of sheets between alternately directed hinges in which adjacent sheets are retained together to provide respective leaves with alternate folds forming a spine 9 and free ends of the leaves, respectively.

In a modification, instead of a thumb wheel having an exposed serrated edge, rotation of the wheel or disk can be effected by grasping a fingerpiece formed by a tab extending from an outer edge through an arcuate slit cut in the sheet and pulling the fingerpiece along the slit. In another modification, instead of the thumb wheel, finger holes are formed along an outside edge of the wheel and an arcuate finger access slot is cut in the sheet enabling the wheel to be rotated incrementally to the next opposition by a finger dialing action Throughout the description, sequences of page numbers are used to indicate successive pages of an individual trick, or pairs of tricks having interactive elements rather than for sequential pages of the book, as additional pages carrying other tricks or descriptive matter can be included.

We claim:

1. A magic set comprising a series of props and a plurality of leaves having faces marked with indicia illustrating ones of scenes and trick elements of a magic show and complementary and interactive with at least selected props of the series of props in forming tricks of the show; hinge means pivotally connecting the leaves along one edge for sequential presentation the improvement residing in that the leaves form a book and at least some of the leaves are provided with means for holding movable props at predetermined different display locations on faces thereof and the indicia associated with the props forming directions for movement of the props and for movement of specific leaves to perform a trick routine and, one of the movable props, moved by a user in accordance with the directions between different display locations on one face of one of the leaves provided with means for holding movable props in the performance routine of one trick mechanically interacts with one of trick indicia and a prop on an opposite face of said one leaf without knowledge of the user in dependence on and determined by directions provided by the indicia to physically provide a single predetermined outcome of one of a same and another, previously initiated trick, while a portion of the prop which would, if seen, reveal a solution to said one of a same and another trick remains concealed from the user so as to be undetected throughout performance routines of said one of a same and another, previously initiated trick, whereby an uninformed user is able to successfully perform tricks simply by manipulating the props and trick elements according to the directions, without solutions of the tricks being necessarily revealed to the user by the performance.

2. A magic set according to claim 1 wherein the props comprise a series of playing cards and the trick resides in predicting a value of one of the playing cards selected by the user, the playing cards having faces with first, correspondingly positioned portions displaying a same, first value as each other and second correspondingly positioned portions displaying different values from each other and the leaf is formed with a window, the holding means comprises a series of pockets provided on a first face of the leaf adjacent the window for initially receiving all playing cards of the series face down with their first portions in respective pockets and their second portions aligned with the window and a single pocket also adjacent the window and means for carrying a note identifying the first value in concealed manner on a subsequent face overleaf from the first face of a leaf, so that when a user moves any selected card face down from the series of pockets into the single pocket according to the directions so that the second portion is received in the pocket and the first portion is aligned with the window, and turns overleaf, the second portion of the face of the selected card is concealed from the view of the user by a wall of the single pocket and first portion of the face of the selected card in the single pocket is exposed through the window in the leaf and corresponds with the value marked on the note and while first portions of the faces of the playing cards which remain in the series of pockets are concealed by walls of their pockets, their second portions are also exposed through the window as all being of different values providing the illusion that the value of the selected card has correctly predicted from a series of cards of different values.

3. A magic set according to claim 2 wherein the series of pockets are aligned in a row on one side of the window and the single pocket is located on an opposite side of the window, with the pockets of the row having respective card receiving openings opening toward a card receiving opening of the single pocket, so that the selected card can be moved by sliding out from a pocket of the row directly across the window into the single pocket.

4. A magic set according to claim 3 wherein the window is covered by a plastic sheet providing a transparent sliding surface.

5. A magic set according to claim 4 wherein the note carrying means comprises an openable envelope.

6. A magic set according to claim 3 wherein the note carrying means is on a first face of a next leaf underlying the first leaf, which face has a portion underlying the window formed with a raised surface protruding into at least part of the cut-out and providing one of a supporting and sliding surface for movement of the selected card and marked with indicia pointing from playing cards of the row to the selected playing card in the single pocket when viewed through the overlying window and to the note carrying means when the leaf formed with the window has been turned over to expose said first face of the next leaf.

7. A magic set according to claim 1 wherein the props comprise an even number of dominoes having the said number of different values each marked thereon twice with each domino having a different combination of end values, a second face of a leaf being marked with indicia forming an elongate framework defining a series of contiguous spaces for receiving all dominoes but one, matched end-to-end, an opposite, first face of a next leaf formed with a single domino receiving slot extending therethrough; the holding means comprising first means for locating the dominoes, values concealed on one of the said first and second faces at a start of a trick routine and second means communicating with the slot for receiving the single domino and locating the single domino, value concealed, on a second, underlying, face of the second leaf, the second leaf being cut away at locations corresponding to the spaces at opposite longitudinal ends of the framework whereby, when, in accordance with the directions, a user removes the dominoes from the first locating means, inserts one domino, values unseen, through the slot into the locating means secured to the second face of the second leaf, arranges the remaining dominoes arranged in a row matched end to end in the framework, and turns forward overleaf, the second leaf overlies and conceals all domino values of the row except the domino values at the opposite ends which are exposed by the cut-aways and the values of the single domino are, when removed from the second locating means, revealed as identical to the values of the two exposed ends of the row, providing the illusion that the value of the two exposed ends has been correctly predicted.

8. A magic set according to claim 7 wherein second locating means comprises an openable envelope.

9. A magic set according to claim 1 wherein one leaf comprising two overlying sheets is provided with props and trick elements of two, interactive tricks, comprise a cut out character of an escapologist, the holding means comprising means on the first sheet for releasably holding the character and a trunk portion defines first and second, visually identical compartments which open in different directions and have a symmetrical, common door having different ends selectively available to the user to provide access to either compartment, the trunk portion being rotatively mounted on a first face of said one leaf to rotate the ends of the door between identical positions;

for a second trick, a magic number wheel mounted in concealed position between the sheets of the single leaf for rotation by a fingerpiece and having a side towards the second sheet with indicia depicting a sequence of arithmetical instructions and a result, at least one window being formed in the second sheet so that each arithmetical instruction is brought into alignment with said at least one window in turn by moving the fingerpiece to rotate the wheel, means extending through the first sheet of the single leaf connecting the trunk portion for rotation by the magic number wheel whereby at a start of the first and second tricks corresponding to the magic number wheel and the door of the trunk portion being at a first rotational position, a first end of the door is available to the user to open the first compartment for receipt of the character released by a user from the first holding means and inserted therein, and when the magic number wheel has been rotated to a final rotational position corresponding with a final step of the magic number trick, the second end of the door has switched positions with the first end of the door so that it is available to the user to open the second compartment, whereby, in accordance with the directions, a user inserts the character in the trunk at the start of the first trick and then turns forward overleaf and rotates the magic number wheel from the start position to the result position in performing the second trick, the rotation positions the trunk door for open the second compartment, so that turning back overleaf and opening the trunk door will display the second compartment which is empty, providing the illusion that the character has escaped from the trunk.

10. A magic set according to claim 9 wherein the trunk portion comprises a sheet bi-folded into a flattened Z-section, forming an inner panel, a center panel and an outer panel, the first and second compartments being defined by the center panel and the outer panel and by the center panel and the inner panel, respectively, with an outer face of the outer panel forming the trunk door.

11. A magic set according to claim 10 wherein biassing means are mounted on the first sheet to slidably engage over one side of the door both to bias the door in a flat, closed position and the compartments in flat position and to prevent a door end being opened when rotated to engage under the biassing means.

12. A magic set according to claim 11 wherein the biassing means comprises a resilient strip secured to a face of the first sheet.

13. A magic set according to claim 11 wherein the resilient strip is transparent plastic.

14. A magic set according to claim 9 wherein a first face of a subsequent leaf is provided with a flap hingedly joined to the face to lie flat thereagainst and a second, identical cut out of the character normally inserted under the flap to be concealed thereby, so that the flap is pivotable away from the face by the user to reveal the character providing the illusion that the character has relocated from the trunk .

15. A magic set according to claim 1 wherein a first face of a leaf forming a right page displays indicia of a playing card of a first value and the props comprise a card holding frame having a central window closed by an interior panel having an appearance identical to a central portion of a playing card and a playing card of different face value located in the frame behind the panel so that only a free end of the playing card protrudes out of the frame appearing to be a continuation of a playing card with the central portion appearing in the panel, providing the illusion that the panel and the visible free end of the card are the same single card, the illusion being reinforced by a statement on the face of the leaf that the card on the face and the card in the frame are identical, the opposite face of the panel having indicia corresponding to background indicia on the first face, means hingedly mounting the frame on the face for flipping over from a first, trick starting position, in which the panel is displayed in the frame window to a second position in which the rear face of the playing card is displayed in the frame window, so that when, in accordance with the directions, the frame is flipped over, withdrawing the single card from the frame progressively reveals an opposite face of the panel showing indicia corresponding to the background indicia in the window, providing the illusion by casual inspection that the frame is now empty, re-enforcing the illusion that the frame contained only the withdrawn card, a second face of the leaf displaying indicia of a playing card of one of said said value and a different value so that, on turning forward overleaf and inspecting the playing card, the different value is revealed as a surprise.

16. A magic set according to claim 15 wherein the holding means comprises a frame retaining flap which releasably retains the frame in the first position tucked, flatly, thereunder.

17. A magic set according to claim 15 wherein the holding means for holding the frame in the second position comprises a tab mounted on the leaf for sliding movement to extend over the frame in the second position.

18. A magic set according to claim 1 wherein the book has a spine extending away from the user so that the leaves are arranged to be turned over side-to-side and the props holding means comprise ones of prop receiving pockets and slots which open away from respective top and bottom edges.

19. A magic set having a series of sheets connected together along a common edge to form a book, at least one of the sheets having props for performing tricks mounted on a face thereof for movement from a first to a second position in which the props cover and expose different spaced apart locations of said face in performance of a trick and, indicia providing a predetermined sequence of several discrete instructional steps marked on the sheet required to perform a same trick, at least at some of said respective spaced apart locations, so that selected of the instructional steps provided by the indicia are initially hidden from spectator view by selected of said props in respective first positions and sequentially exposed to spectator view only by predtermined sequential movement of said selected props to said respective second positions in performance of a preceding instructed step.

20. A magic set according to claim 19 wherein the props include flaps attached to the face for one of pivotal or sliding movement between the respective positions.

21. A magic set having a series of sheets connected together along a common edge to form a book, and successive pages formed by opposite faces of a leaf carrying props movable between different positions in performance of respective magic tricks and being interconnected by at least one mechanical member extending through the leaf so that movement of a prop on the successive page secretly moves a prop, previously viewed on a preceding page which appears not to have been moved from a prior position but is actually in a different position, such secret movement altering the position of another prop or indicia on the preceding page or prop producing a single, predetermined result, thereby setting up a trick performed and observed only by turning back to the previous page.

22. A magic set having a series of leaves connected together along a common edge to form a book, a series of props for use in performing tricks, first means on a leaf for securing a prop of a trick in a first position in which a first portion of the prop is concealed from view on a first face of the leaf forming a first page;

second means on the leaf spaced apart from the first means and comprising one of an aperture or window to the second face, for securing said prop in a second position spaced from the first position in which a second portion of the prop is concealed from view on the first page in performance of the trick and in which the prop is positioned for immediate or subsequent exposure to view of the first portion on the second page in performance of a same trick by turning overleaf.

* * * * *